US008366074B2

(12) United States Patent
Lin

(10) Patent No.: US 8,366,074 B2
(45) Date of Patent: Feb. 5, 2013

(54) ILLUMINATIVE JACK

(76) Inventor: Lai-Shun Lin, Chia-Yi Hsien (TW)

( * ) Notice: Subject to any disclaimer, the term of this patent is extended or adjusted under 35 U.S.C. 154(b) by 0 days.

(21) Appl. No.: 13/350,747

(22) Filed: Jan. 14, 2012

(65) Prior Publication Data

US 2012/0175577 A1 Jul. 12, 2012

Related U.S. Application Data

(63) Continuation of application No. 12/558,564, filed on Sep. 13, 2009, now Pat. No. 8,118,279, which is a continuation of application No. 11/609,426, filed on Dec. 12, 2006, now Pat. No. 7,588,341.

(51) Int. Cl.
*B66F 5/04* (2006.01)

(52) U.S. Cl. ..... 254/8 B; 254/2 B; 254/133 R; 254/120; 362/253; 362/119

(58) Field of Classification Search ..... 254/8 B, 254/2 B, 133 R, 120, 131, 6 B, 93 L, 7 B, 254/7 R; 362/119, 109, 253
See application file for complete search history.

(56) References Cited

U.S. PATENT DOCUMENTS

| | | | | |
|---|---|---|---|---|
| 4,018,421 | A | 4/1977 | Tallman | |
| 4,872,230 | A | 10/1989 | Levine | |
| D332,337 | S | 1/1993 | Wang | |
| 5,992,826 | A | 11/1999 | Simmonds | |
| 6,375,160 | B1 | 4/2002 | Hung | |
| 6,642,667 | B2 | 11/2003 | Avis | |
| 6,848,673 | B1 | 2/2005 | McLaughlin et al. | |
| 6,910,677 | B1 * | 6/2005 | Miller et al. | 254/126 |
| 7,163,312 | B2 | 1/2007 | Woodyard | |
| 7,207,548 | B1 * | 4/2007 | Howe | 254/98 |
| 7,309,140 | B2 | 12/2007 | Huang | |
| 7,588,341 | B2 * | 9/2009 | Lin | 362/119 |
| 2003/0043581 | A1 * | 3/2003 | Finnigan | 362/253 |
| 2008/0013317 | A1 | 1/2008 | Hinds | |
| 2008/0128429 | A1 | 6/2008 | Towery et al. | |
| 2008/0137338 | A1 * | 6/2008 | Lin | 362/253 |
| 2010/0001240 | A1 * | 1/2010 | Lin | 254/120 |

* cited by examiner

*Primary Examiner* — Lee D Wilson
(74) *Attorney, Agent, or Firm* — Cherskov Flaynik & Gurda, LLC

(57) ABSTRACT

An illuminative jack is described; the jack contains a pair of side walls spaced apart from one another. Each side wall has a front portion, an intermediate region, and an end portion. The jack includes a lift arm which has a first end which is pivotally connected to the intermediate regions of the side walls and a second end close to the front portions. A lifting plate is connected to the second end of the lift arm, the plate is designed to engage a lifting location of an object to be lifted. Finally, the jack includes several lights recessed within the plate and a shield material for the lights.

13 Claims, 4 Drawing Sheets

ILLUMINATIVE JACK

CROSS REFERENCE TO RELATED APPLICATION

This application is a continuation of U.S. application Ser. No. U.S. application Ser. No. 12/558,564 filed on Sep. 13, 2009, presently pending, which in turn claims priority to U.S. application Ser. No. 11/609,426, filed Dec. 12, 2006, issued as U.S. Pat. No. 7,588,341 on Sep. 15, 2009, both of which are herein incorporated by reference.

FIELD OF THE INVENTION

The present invention relates to an illuminative jack, wherein a lighting device is disposed in a top plate of the jack, and the lighting device is supplied by a power source and is controlled by a switch. By such arrangements, when the user switches on the switch, the lighting device will be radiated to illuminate a lifting object.

BACKGROUND OF THE INVENTION

A jack is a device for lifting a heavy object and has the properties of easy moving and operation, so the jack is widely used in various industries, and vehicle maintenance in particular. Therefore, almost each vehicle is prepared for a jack.

Since the jack is provided for lifting the heavy object, in operation, the jack must be pushed to the bottom of the heavy object, such that the jack will be shaded by the shadow of the heavy object, and at night and the area of insufficient light in particular, and the user is unable to determine the position of a top plate of the jack. In order to solve this problem, the user has to push the jack to adjust the position of the jack by one hand, and to grip a lighting device by the other hand, so as to illuminate the position between the jack and the bottom of the heavy object, which is inconvenient to the user. Moreover, the user may have no lighting device to use, so the conventional jack cannot meet the users' requirement.

The present invention has arisen to mitigate and/or obviate the afore-described disadvantages.

SUMMARY OF THE INVENTION

The primary objective of the present invention is to provide an illuminative jack comprises a plurality of lights disposed in a top plate to illuminate a lifting location. The jack includes transparent material positioned disposed below the contact surface of the top plate and disposed above the plurality of lights to protect the lights, while allowing light to emanate on the lifting location. The jack can further include a switch for operating the lights disposed on a lifting arm Since the lighting device is disposed in the top plate of the jack, in operation, the lighting device will be radiated by switching on the switch. Thereby, when the user pushes the jack to the bottom of a heavy object, the bottom of the heavy object can be illuminated adequately. Thereby, the user can see the position of the jack opposite to the bottom of the heavy object clearly, so as to determine the distance and the position between the top plate and the lifted heavy object (since the top plate is in contact with the object directly, the lighting device disposed in the top plate has better illumination effect), and to prevent the jack from being influenced by insufficient light (a dark area in particular). Moreover, the lighting device is disposed in the top plate, so the function of the top plate will not be hindered, and the present jack is easy to operate and is practical.

The present invention will become more obvious from the following description when taken in connection with the accompanying drawings, which show, for purpose of illustrations only, the preferred embodiments in accordance with the present invention.

BRIEF DESCRIPTION OF THE DRAWINGS

Embodiments of the present invention will now be described, by way of example only, with reference to the following drawings in which.

DETAILED DESCRIPTION

Figure 1:
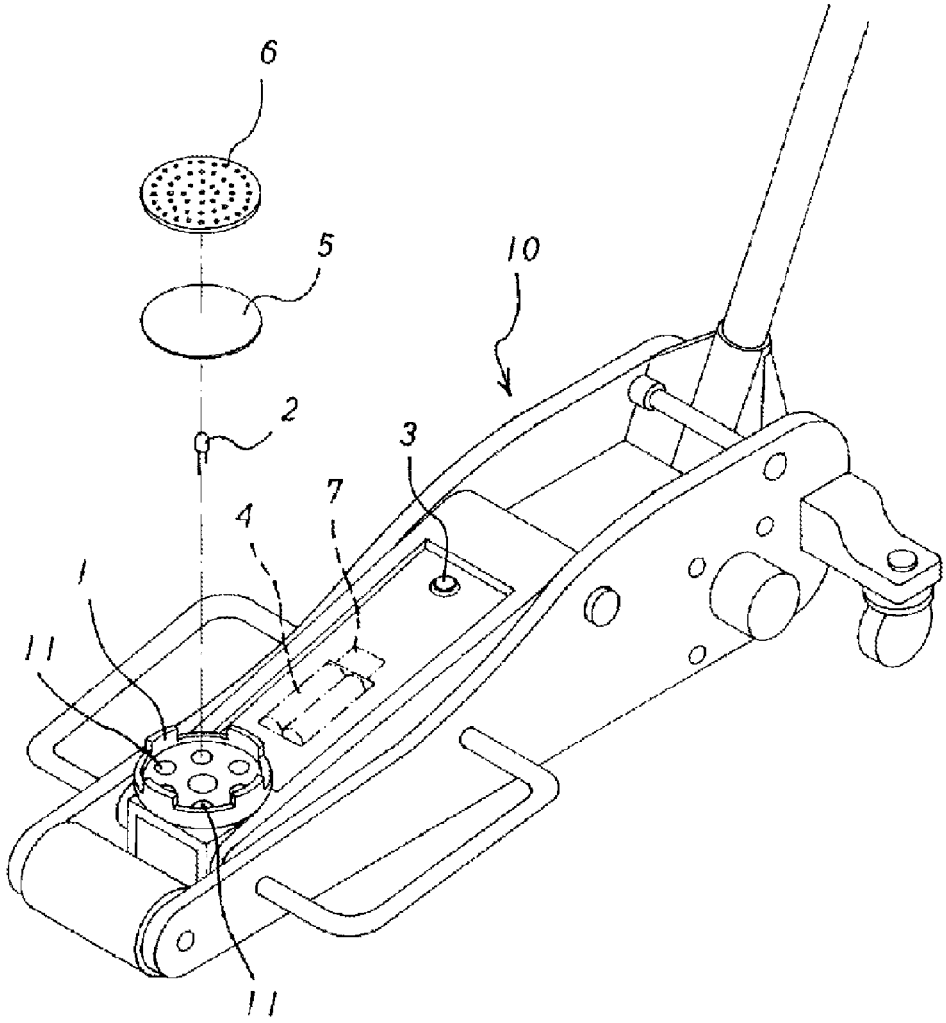
FIG. 1 is a partially exploded view of an illuminative jack in accordance with the present invention.

Referring to FIG. 1, an illuminative jack 10 in accordance with the present invention comprises a lighting device 2 disposed in a top plate 1 of the jack 10, and the lighting device 2 is controlled by a switch 3 and is connected to a power source 4 (as shown in FIG. 1, the lighting device can be a bulb, LED or other luminaries). Thereby, when the user switches on the switch 3, the lighting device 2 will be radiated by the power supplied by the power source 4, thus providing an illumination effect.

Figure 2:
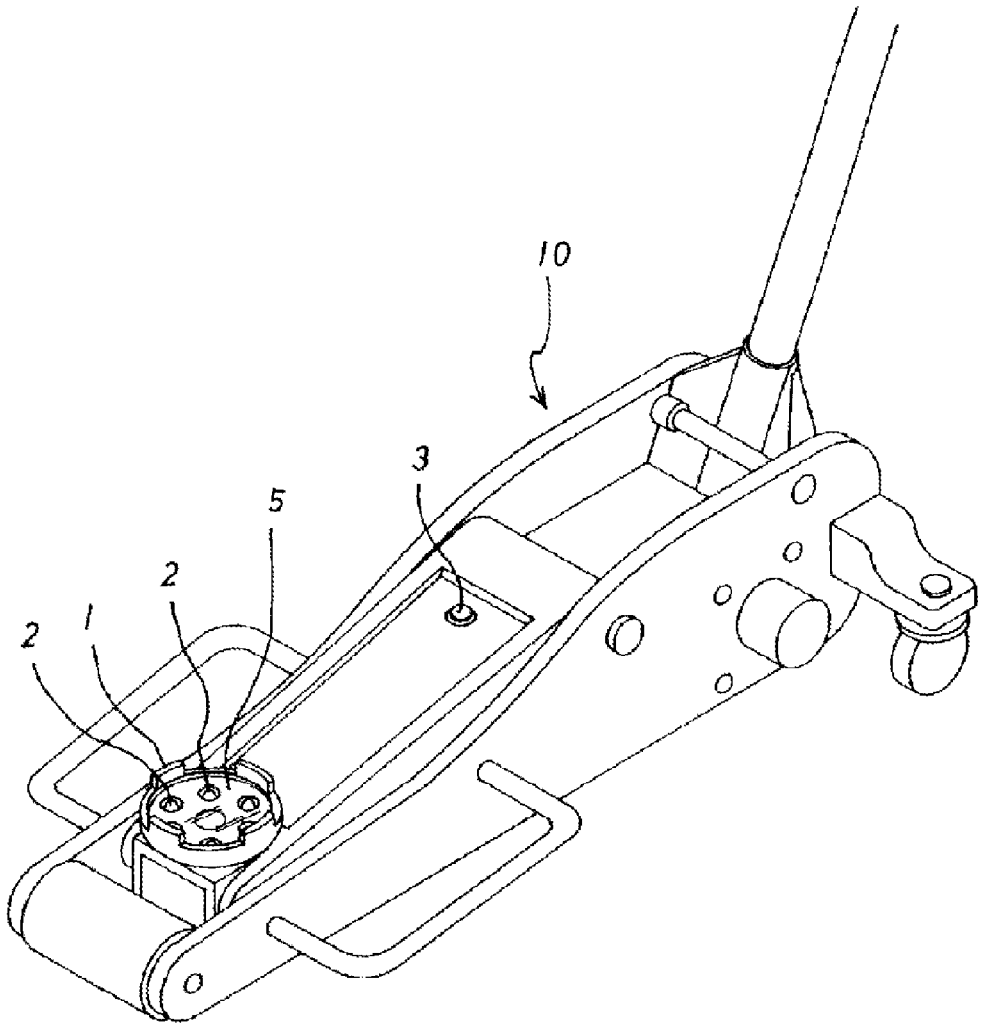
FIG. 2 is a perspective view of the illuminative jack in accordance with the present invention.
Figure 3:
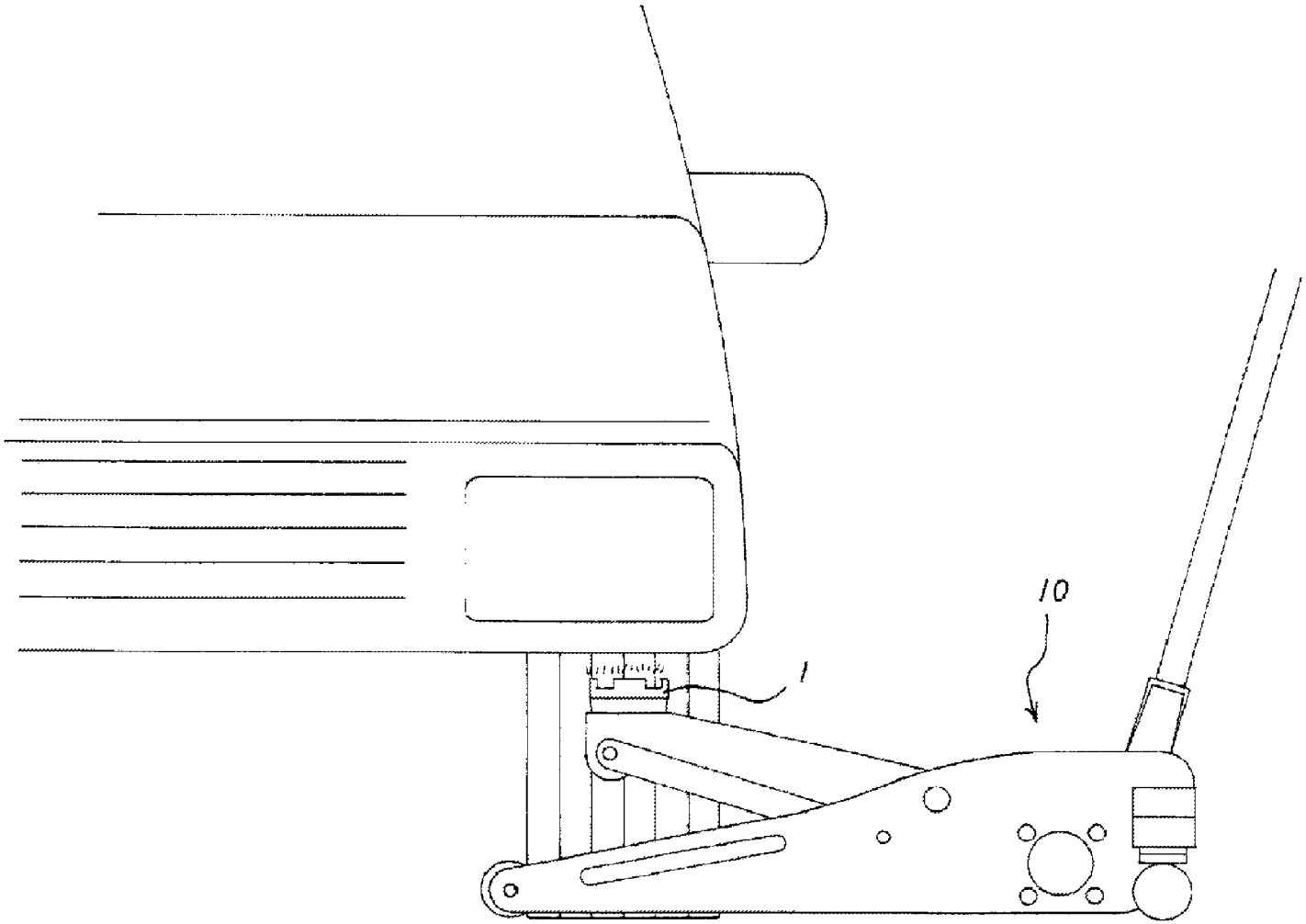
FIG. 3 is an illustrative plan view of the illuminative jack in accordance with the present invention.

When the jack 10 of the present invention has an illumination effect (as shown in FIG. 2), the user can switch on the lighting device 2 via the switch 3 under a dark area according to the actual requirements (as shown in FIG. 3), so as to illuminate the bottom of a heavy object to be lifted directly, thus solving the problem of insufficient light. Thereby, the user need not to grip the lighting device by the other hand, and the heavy object can be illuminated by adjusting the position of the jack 10 directly, so the present invention is easy to operate.

Figure 4:
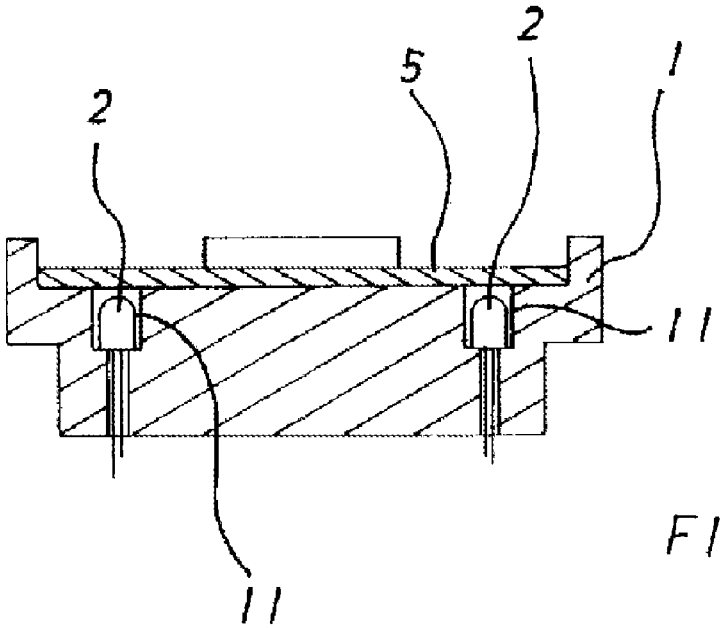
FIG. 4 is a cross sectional view of a top plate of the illuminative jack in accordance with the present invention.

In addition, the top plate 1 of the jack 10 is defined with a plurality of receiving grooves 11 (as shown in FIG. 4) for receiving the lighting device 2, and a transparent cover 5 is provided for protecting the lighting device 2.

Further, a pad 6 is covered on an upper portion of the transparent cover 5, to prevent the transparent cover 5 from being abraded when the lighting device 2 is not in use.

The switch 3 of the present invention can be connected to a timer 7 in such a manner that when the user switches on the switch 3, the output power of the power source 4 can be cut off automatically after a scheduled time (such as three minutes), thus preventing the waste of the power when the user forgets to switch off the switch 3.

Figure 5:
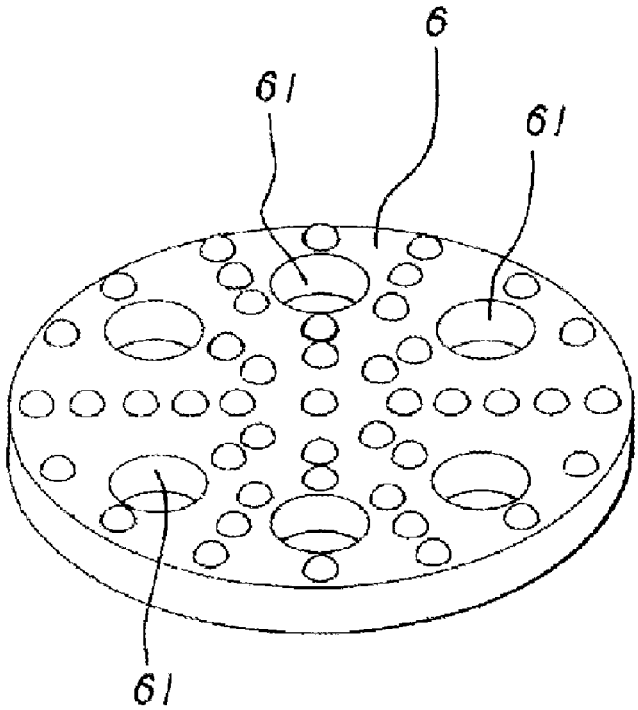
FIG. 5 is a perspective view of a pad of the illuminative jack in accordance with the present invention.

The pad 6 can be defined with a plurality of through holes 61 located correspondingly to the lighting device 2 of the top plate 1 (as shown in FIG. 5), to illuminate the lifting object directly.

While we have shown and described various embodiments in accordance with the present invention, it should be clear to those skilled in the art that further embodiments may be made without departing from the scope of the present invention.

What is claimed is:

1. An illuminative jack, comprising:

a pair of elongated side walls in spaced relationship from one another, each side wall having a front portion, an intermediate region, and an end portion;

a lift arm having a first end pivotally coupled to the intermediate regions of the side walls and a second end proximate to the front portions;

a plate coupled to the second end of the lift arm, the plate configured to engage a lifting location of an object to be lifted;

a plurality of lights recessed within the plate; and a shield material positioned disposed below an upper surface of the plate and disposed above the plurality of lights to protect the lights.

2. An illuminative jack as set forth in claim 1, wherein the plate includes an upstanding ridge about the periphery thereof.

3. An illuminative jack as set forth in claim 1, wherein the shield material is configured as a single transparent cover disposed over the central region of the plate covering the plurality of lights.

4. An illuminative jack as set forth in claim 3, wherein the single transparent cover includes an outer edge configured to be proximate to an upstanding ridge about the circumference thereof.

5. An illuminative jack as set forth in claim 1, further comprising a switch configured to control the plurality of lights.

6. An illuminative jack as set forth in claim 5, wherein the switch is disposed on the lifting arm and the switch is connected to a timer that extinguishes the lights after a prescribed time.

7. An illuminative jack as set forth in claim 1, further comprising a contact surface for engaging the lifting location, the contact surface defining at least one through hole to allow light to emanate on the lifting location.

8. An illuminative jack as set forth in claim 7, wherein the transparent material is disposed below the contact surface.

9. An illuminative jack, comprising:

a pair of elongated side walls in spaced relationship from one another, each side wall having a front portion, an intermediate region, and an end portion;

a lift arm having a first end pivotally coupled to the intermediate regions of the side walls and a second end proximate to the front portions;

a plate coupled to the second end of the lift arm, the plate configured to engage a lifting location of an object to be lifted, the plate defining a plurality of grooves;

a plurality of lights completely recessed within the plurality of grooves of the plate and oriented to provide illumination directed to the lifting location; and shield material positioned disposed below an upper surface of the plate and disposed above the plurality of lights to protect the lights.

10. An illuminative jack as set forth in claim 9, further comprising a contact surface for engaging the lifting location, the contact surface defining at least one through hole to allow light to emanate on the lifting location.

11. An illuminative jack as set forth in claim 10, wherein the contact surface defines a plurality of through holes aligned with the plurality of lights to allow light to emanate on the lifting location.

12. An illuminative jack as set forth in claim 10, wherein the transparent material is disposed below the contact surface.

13. An illuminative jack as set forth in claim 9, wherein the plurality of lights includes six lights, each light received within a corresponding groove of the plurality of grooves of the plate.

* * * * *